US010736801B2

(12) United States Patent
Lin

(10) Patent No.: US 10,736,801 B2
(45) Date of Patent: Aug. 11, 2020

(54) WHEELCHAIR

(71) Applicant: Karma Medical Products Co., Ltd., Minsyong Township (TW)

(72) Inventor: Yen-Tsung Lin, Minsyong Township (TW)

(73) Assignee: Karma Medical Products Co., Ltd., Minsyong Township (TW)

( * ) Notice: Subject to any disclaimer, the term of this patent is extended or adjusted under 35 U.S.C. 154(b) by 178 days.

(21) Appl. No.: 16/051,617

(22) Filed: Aug. 1, 2018

(65) Prior Publication Data

US 2019/0038488 A1 Feb. 7, 2019

(30) Foreign Application Priority Data

Aug. 3, 2017 (TW) ..... 106126227 A

(51) Int. Cl.

| | |
|---|---|
| ***A61G 5/02*** | (2006.01) |
| ***A61G 5/12*** | (2006.01) |
| *A61G 5/14* | (2006.01) |

(52) U.S. Cl.

CPC ..... *A61G 5/128* (2016.11); *A61G 5/02* (2013.01); *A61G 5/127* (2016.11); *A61G 5/14* (2013.01)

(58) Field of Classification Search

CPC ..... A61G 5/128; A61G 5/02; A61G 5/127; A61G 5/14

See application file for complete search history.

(56) References Cited

U.S. PATENT DOCUMENTS

| | | | | |
|---|---|---|---|---|
| 3,205,007 A | | 9/1965 | Sommer | |
| 3,758,150 A | | 9/1973 | Williams | |
| 4,462,604 A | * | 7/1984 | Meyer | A61G 5/00 280/250.1 |
| 5,277,477 A | * | 1/1994 | Sharff | A61G 5/12 297/313 |
| 7,347,497 B2 | * | 3/2008 | Fujihara | A61G 5/12 280/304.1 |

(Continued)

FOREIGN PATENT DOCUMENTS

| | | |
|---|---|---|
| CN | 104275981 A | 1/2015 |
| GB | 1106889 A | 3/1968 |

(Continued)

OTHER PUBLICATIONS

Search Report appended to an Office Action issued to Chinese counterpart application No. 201710730245.3 by the CNIPA dated Feb. 19, 2020, with an English translation thereof.

(Continued)

*Primary Examiner* — Tony H Winner
*Assistant Examiner* — Marlon A Arce
(74) *Attorney, Agent, or Firm* — Akerman LLP; Peter A. Chiabotti

(57) ABSTRACT

A wheelchair includes a chair frame mechanism and two pedal mechanisms. The chair frame mechanism includes a frame body and two pedal-mounting rods. The pedal mechanisms are respectively mounted to the pedal-mounting rods. Each of the pedal mechanisms includes a pivot unit sleeved on the corresponding pedal-mounting rod and having has a guide groove, a positioning unit mounted to the corresponding pedal-mounting rod and engaging the guide groove, and a pedal unit mounted to the pivot unit.

9 Claims, 11 Drawing Sheets

(56) References Cited

U.S. PATENT DOCUMENTS

| | | | | |
|---|---|---|---|---|
| 2003/0075967 | A1 | 4/2003 | Ciolfe et al. | |
| 2013/0214509 | A1* | 8/2013 | Melgarejo | A61G 5/12 280/304.1 |
| 2017/0273839 | A1* | 9/2017 | Itano | A61G 5/125 |
| 2017/0281437 | A1* | 10/2017 | Itano | A61G 5/128 |
| 2019/0038488 | A1* | 2/2019 | Lin | A61G 5/128 |
| 2019/0201259 | A1* | 7/2019 | Hanley | A61G 5/1051 |

FOREIGN PATENT DOCUMENTS

| | | | |
|---|---|---|---|
| JP | 2000257624 | A | 9/2000 |
| JP | 2004261446 | A | 9/2004 |
| JP | 2010236639 | A | 10/2010 |
| JP | 2012017786 | A | 1/2012 |

OTHER PUBLICATIONS

Examination Report issued to Indian counterpart application No. 201834028494 dated Feb. 11, 2020.

* cited by examiner

WHEELCHAIR

CROSS-REFERENCE TO RELATED APPLICATION

This application claims priority of Taiwanese Invention Patent Application No. 106126227, filed on Aug. 3, 2017.

FIELD

The disclosure relates to transport equipment, and more particularly to a wheelchair.

BACKGROUND

Referring to FIGS. 1 to 3, a conventional wheelchair 1 includes a chair frame 11 that permits a user to sit thereon, a plurality of wheels 12 that are mounted to the chair frame 11, two spaced-apart pedal-mounting rods 13 that are mounted to a front portion of the chair frame 11, and two pedal units 14 that are respectively and removably mounted to the pedal-mounting rods 13 for supporting the user's feet.

Each of the pedal-mounting rods 13 is formed with a plurality of positioning grooves 131 that are spaced apart from each other along the extending direction of the corresponding pedal-mounting rod 13. Each of the positioning grooves 131 extends in a direction transverse to the extending direction of the corresponding pedal-mounting rod 13. Each of the pedal units 14 includes an installation rod 141 that is mounted to the corresponding one of the pedal-mounting rods 13, a resilient latch 142 that is movably mounted to the installation rod 141, and a pedal 143 that is pivoted to a bottom end of the installation rod 141. When the pedal units 14 are respectively mounted to the pedal-mounting rods 13, the resilient latch 142 of each of the pedal units 14 engages a selected one of the positioning grooves 131 of the corresponding pedal mounting rod 13.

When the user is to get out of the conventional wheelchair 1, the installation rods 141 of the pedal units 14 are able to respectively rotate relative to the pedal mounting rods 13, and the resilient latches 142 of the pedal units 14 respectively move along the corresponding positioning grooves 131 of the pedal mounting rods 13, so that the pedals 143 of the pedal units 14 are moved away from each other to form a space therebetween for facilitating the exit of the user.

However, the range of the rotation of each of the installation rods 141 are limited by the length of the positioning grooves 131 of the pedal mounting rods 13. When the positioning grooves 131 are too short, the space formed between the pedals 143 may not be sufficient for the exit of the user. When the positioning grooves 131 are too long, the structural strength of the pedal mounting rods 13 may be inferior. With particular reference to FIG. 3, the resilient latch 142 of each of the pedal units 14 can be depressed to be removed from the corresponding positioning groove 131 for increasing the range of the rotation of the corresponding installation rod 141. However, such operation may easily cause injury of the user, and cause separation of each of the installation rods 141 from the corresponding pedal mounting rod 13.

SUMMARY

Therefore, an object of the disclosure is to provide a wheelchair that can alleviate at least one of the drawbacks of the prior art.

According to the disclosure, the wheelchair includes a chair frame mechanism and two pedal mechanisms. The chair frame mechanism includes a frame body, and two pedal-mounting rods that are disposed at a front side of the frame body. The pedal mechanisms are respectively mounted to the pedal-mounting rods. Each of the pedal mechanisms is able to be positioned relative to the corresponding pedal-mounting rod at a close position and an open position. Each of the pedal mechanisms includes a pivot unit that is sleeved on the corresponding pedal-mounting rod and that is rotatable about and movable along the corresponding pedal-mounting rod, a positioning unit that is mounted to the corresponding pedal-mounting rod, that partially projects out of an outer surface of the corresponding pedal-mounting rod, and that engages the pivot unit, and a pedal unit that is mounted to the pivot unit. The pivot unit of each of the pedal mechanisms has a guide groove that is formed in an inner surrounding surface thereof and that is slidably engaged with the positioning unit. The guide groove of each of the pedal mechanisms has a middle groove section that extends in a circumferential direction of the pivot unit, and first and second groove sections that extend upwardly respectively from two opposite end of the middle groove section. For each of the pedal mechanisms, when the pedal mechanism is at the close position, the positioning unit engages the first groove section of the guide groove, and the pedal mechanism is located at the front side of the frame body. When the pedal mechanism is at the open position, the positioning unit engages the second groove section of the guide groove, and the pedal mechanism is located at a lateral side of the frame body. The pivot unit is operable to be moved upwardly relative to the corresponding pedal-mounting rod, so that the positioning unit is disengaged from one of the first and second groove sections and engages the middle groove section so as to permit relative rotation between the pivot unit and the corresponding pedal-mounting rod for movement of the pedal mechanism between the close position and the open position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
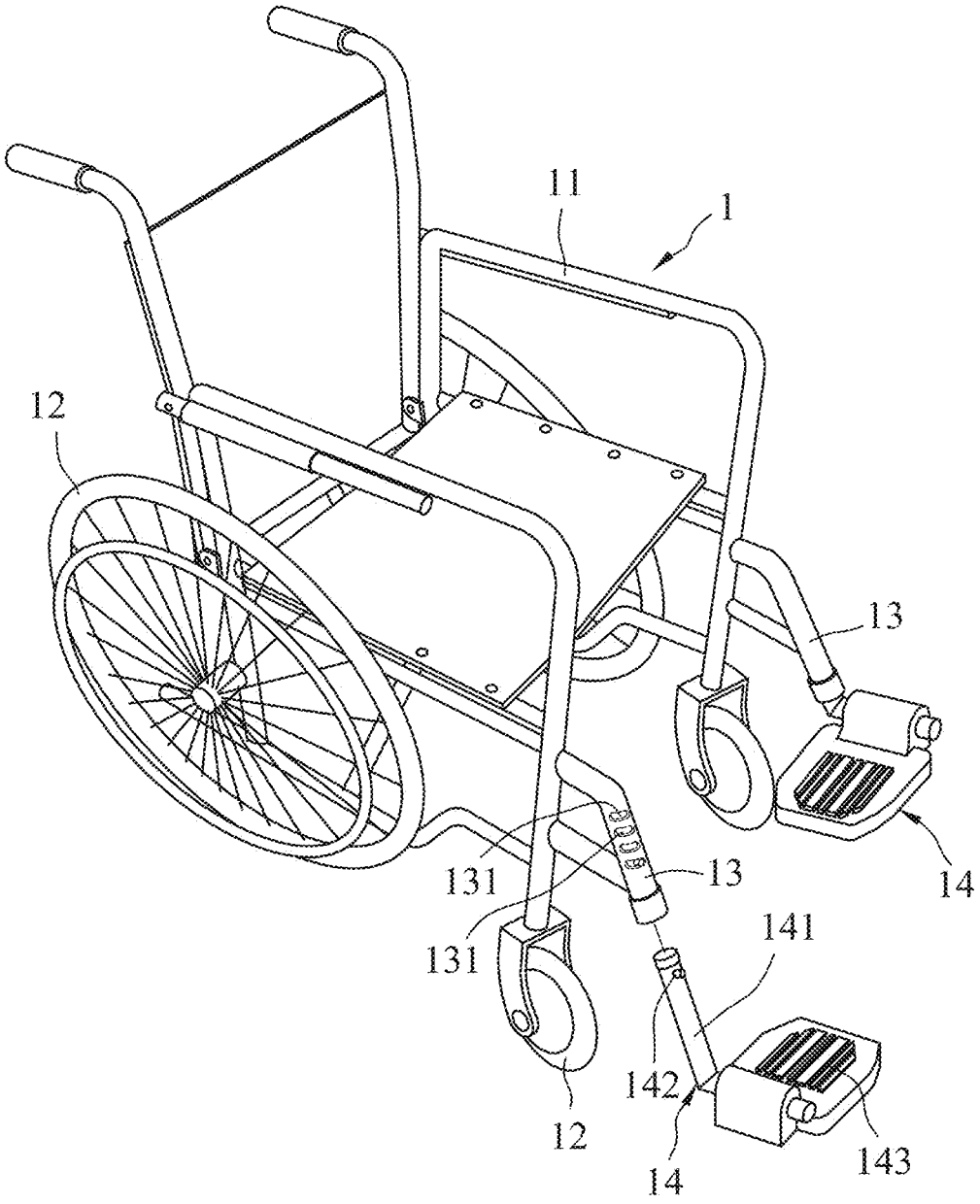
FIG.1 PRIOR ART
FIG. 1 is a partly exploded perspective view illustrating a conventional wheelchair.
Figure 2:
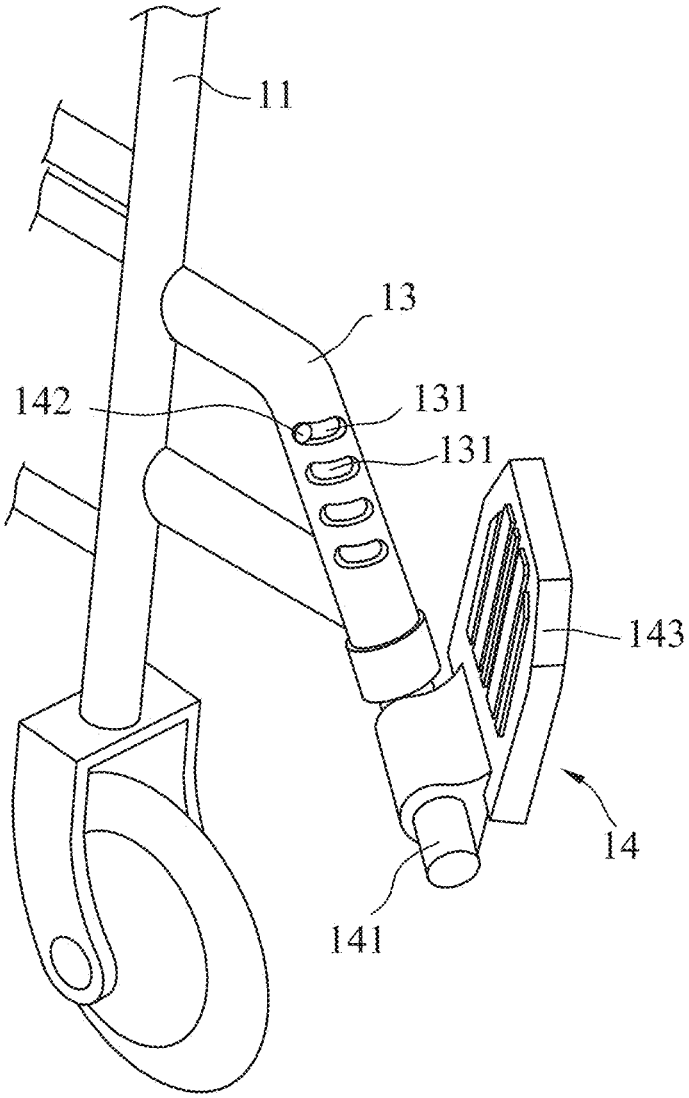
FIG.2 PRIOR ART
FIG. 2 is a fragmentary perspective view illustrating a pedal unit of the conventional wheelchair mounted to a pedal-mounting rod of the conventional wheelchair mounted.
Figure 3:
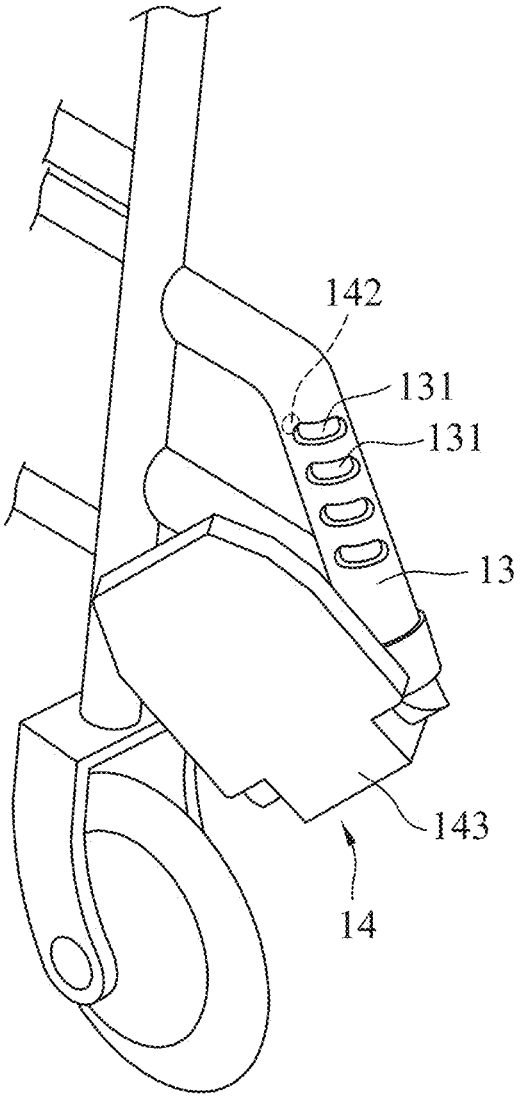
FIG.3 PRIOR ART
FIG. 3 is another fragmentary perspective view illustrating the pedal unit rotated relative to the pedal-mounting rod

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
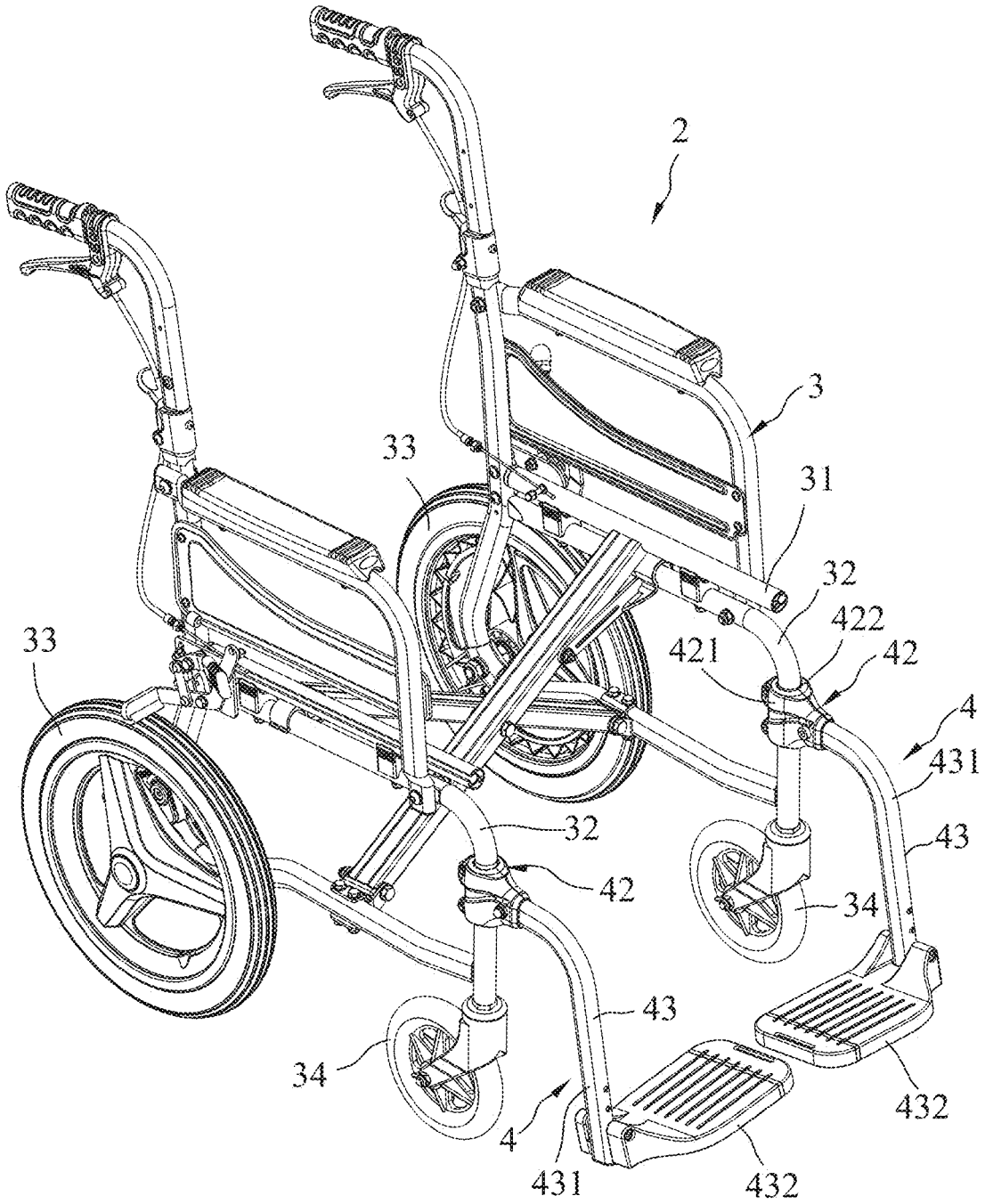
FIG. 4 is a perspective view illustrating a first embodiment of the wheelchair according to the disclosure.
Figure 5:
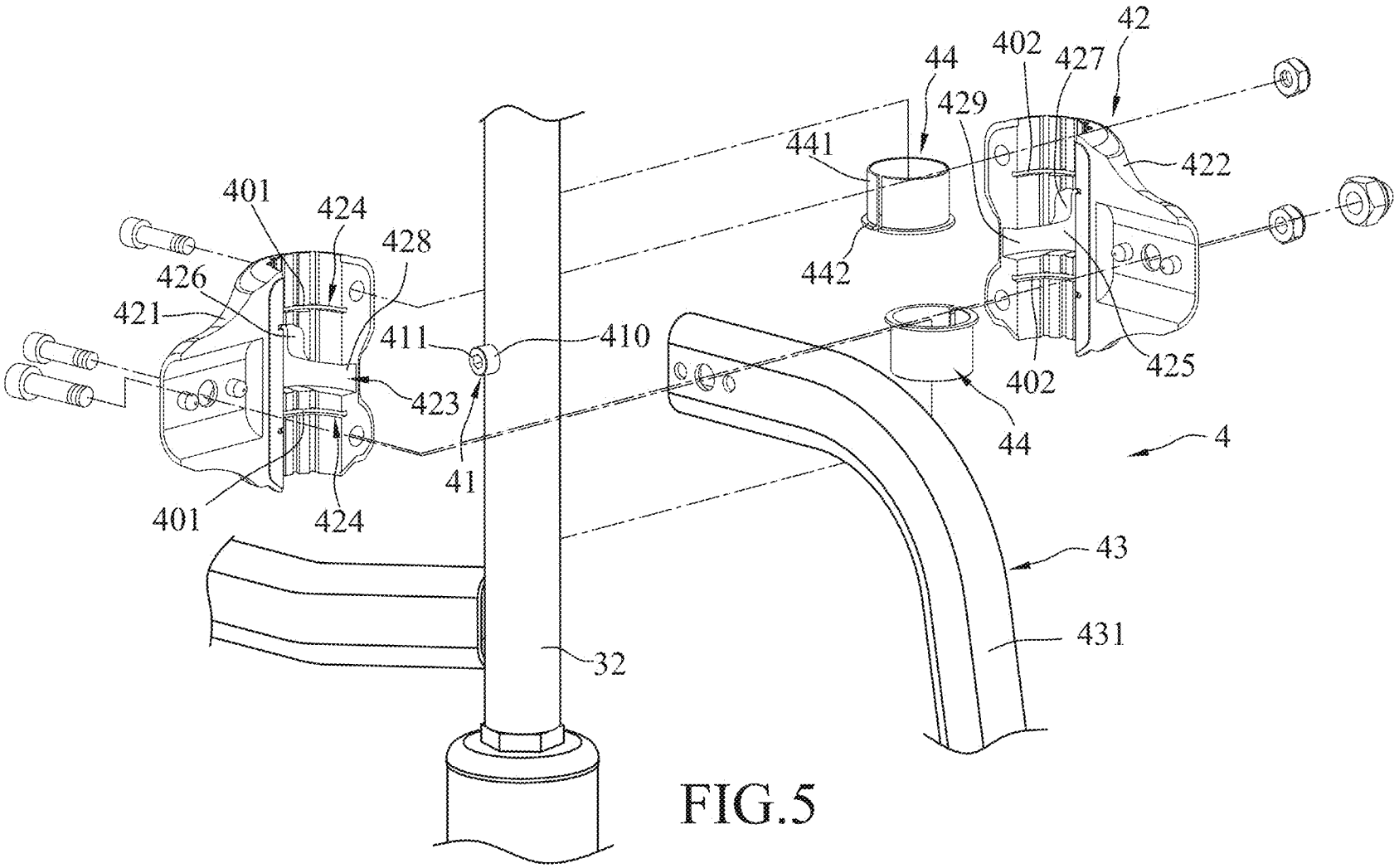
FIG. 5 is a fragmentary partly exploded perspective view illustrating a positioning unit, a pivot unit and a pedal unit of a pedal mechanism of the first embodiment.
Figure 6:
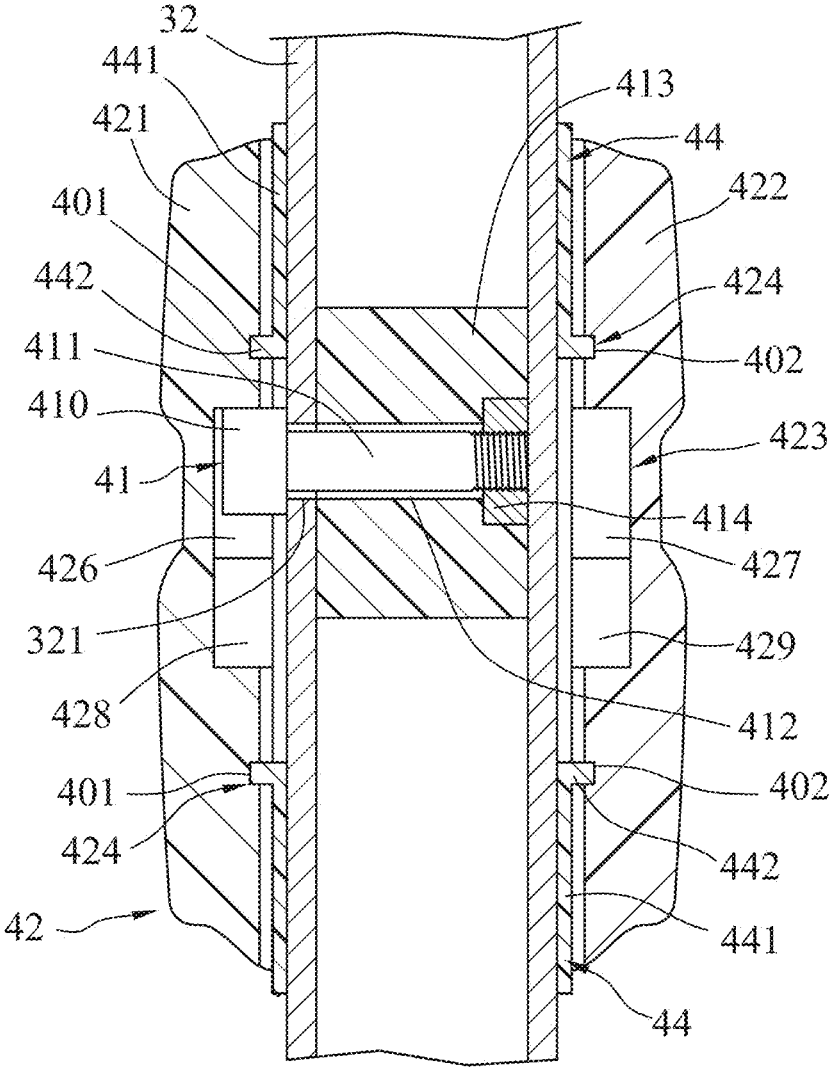
FIG. 6 is a sectional view illustrating the positioning unit and the pivot unit.

Referring to FIGS. 4 to 6, the first embodiment of the wheelchair 2 according to the disclosure permits a user (not shown) to sit thereon, and includes a chair frame mechanism 3 and two pedal mechanisms 4. In the following paragraphs, the front side of the user in the wheelchair 2 is denoted as the front side of the wheelchair 2, the left side of the user is denoted as the left side of the wheelchair 2, and the rest may be deduced by analogy.

The chair frame mechanism 3 includes a frame body 31, two pedal-mounting rods 32 that are disposed at a front side of the frame body 31 and that are spaced apart from each other in a left-right direction, two main wheels 33 that are respectively mounted to left and right sides of the frame body 31, and two caster wheels 34 each of which is mounted to a bottom side of a respective one of the pedal-mounting rods 32. Each of the pedal-mounting rods 32 has a mounting hole 321 (see FIG. 6) that extends in a radial direction of the corresponding pedal-mounting rod 32 and that is formed through the outer surface of the corresponding pedal-mounting rod 32. In this embodiment, each of the pedal-mounting rods 32 is hollow.

The pedal mechanisms 4 are respectively mounted to the pedal-mounting rods 32. Each of the pedal mechanisms 4 includes a positioning unit 41, a pivot unit 42, a pedal unit 43 and two bushings 44. For the sake of brevity, only the left one of the pedal mechanism 4 and the corresponding pedal-mounting rod 32 is described in the following paragraphs.

The positioning unit 41 includes a stuff block 413 (see FIG. 6) that is disposed in the pedal-mounting rod 32 and that is formed with an installation hole 412 aligned with the mounting hole 321 of the pedal-mounting rod 32, a nut 414 (see FIG. 6) that is disposed in the pedal-mounting rod 32 and that is aligned with the installation hole 412, and a bolt 411 that extends through the mounting hole 321 and the installation hole 412 to engage threadedly the nut 414 and that has a head portion 410 disposed out of the pedal-mounting rod 32. In one embodiment, the nut 414 is mounted to the stuff block 413.

The pivot unit 42 is sleeved on the pedal-mounting rod 32, and is rotatable about and movable along the pedal-mounting rod 32. The pivot unit 42 has a guide groove 423 that is formed in an inner surrounding surface thereof and that substantially extends in a circumferential direction thereof, and two installation grooves 424 that are formed in the inner surrounding surface thereof and that are respectively located at upper and lower sides of the guide groove 423. The head portion 410 of the bolt 411 slidably engages the guide groove 423 of the pivot unit 42. The bushings 44 are respectively mounted to the installation grooves 424.

In this embodiment, the pivot unit 42 includes interconnected first and second casings 421, 422. The first and second casings 421, 422 cooperatively define the guide groove 423 and the installation grooves 424.

The guide groove 423 has a middle groove section 425 that is partially formed in the first casing 421 and partially formed in the second casing 422 and that extends in the circumferential direction of the pivot unit 42, a first groove section 426 that is formed in the first casing 421 and that extends upwardly from an end of the middle groove section 425, and a second groove section 427 that is formed in the second casing 422 and that extends upwardly from the other end of the middle groove section 425. The middle groove section 425 has a first middle groove part 428 that is formed in the first casing 421 and that is in spatial communication with the first groove section 426, and a second middle groove part 429 that is formed in the second casing 422 and that is in spatial communication with the second groove section 427.

Each of the installation grooves 424 is annular, and has a first groove portion 401 that is formed in the first casing 421, and a second groove portion 402 that is formed in the second casing 422.

It should be noted that the two-piece pivot unit 42 that includes the first and second casings 421, 422 of this embodiment facilitates the installation of the pivot unit 42 onto the pedal-mounting rod 32. However, in a modification, the pivot unit 42 may be a one-piece element, and the guide groove 423 and the installation grooves 424 are formed in an inner surface of the pivot unit 42.

The bushings 44 are mounted in the pivot unit 42, and are spaced apart from each other in a top-bottom direction. Each of the bushings 44 has a surrounding portion 441 that is sleeved on the pedal-mounting rod 32, and an installation portion 442 that extends radially and outwardly from the surrounding portion 441 and that engages the corresponding one of the installation grooves 424. The bushings 44 serve for reducing wear between the pivot unit 42 and the pedal-mounting rod 32. In this embodiment, each bushing 44 and the pedal-mounting rod 32 are in interference fit, and each bushing 44 and the pivot unit 42 are in clearance fit. In a modification, each bushing 44 and the pedal-mounting rod 32 may be in clearance fit, and each bushing 44 and the pivot unit 42 may be in interference fit (i.e., the installation portion 442 of each of the bashings 44 is press-fitted into the corresponding installation groove 424).

The pedal unit 43 is fixedly mounted to the pivot unit 42 by screw-fastening, so that the pedal unit 43 is rotatable about and movable along the pedal-mounting rod 32. The pedal unit 43 includes an arc-shaped extending rod 431 that has a top end connected to the pivot unit 42, and a pedal 432 that is pivoted to a bottom end of the extending rod 431 for supporting the user's foot. In this embodiment, the pedal 432 is pivotable relative to the extending rod 431 about a substantially horizontal axis.

Figure 8:
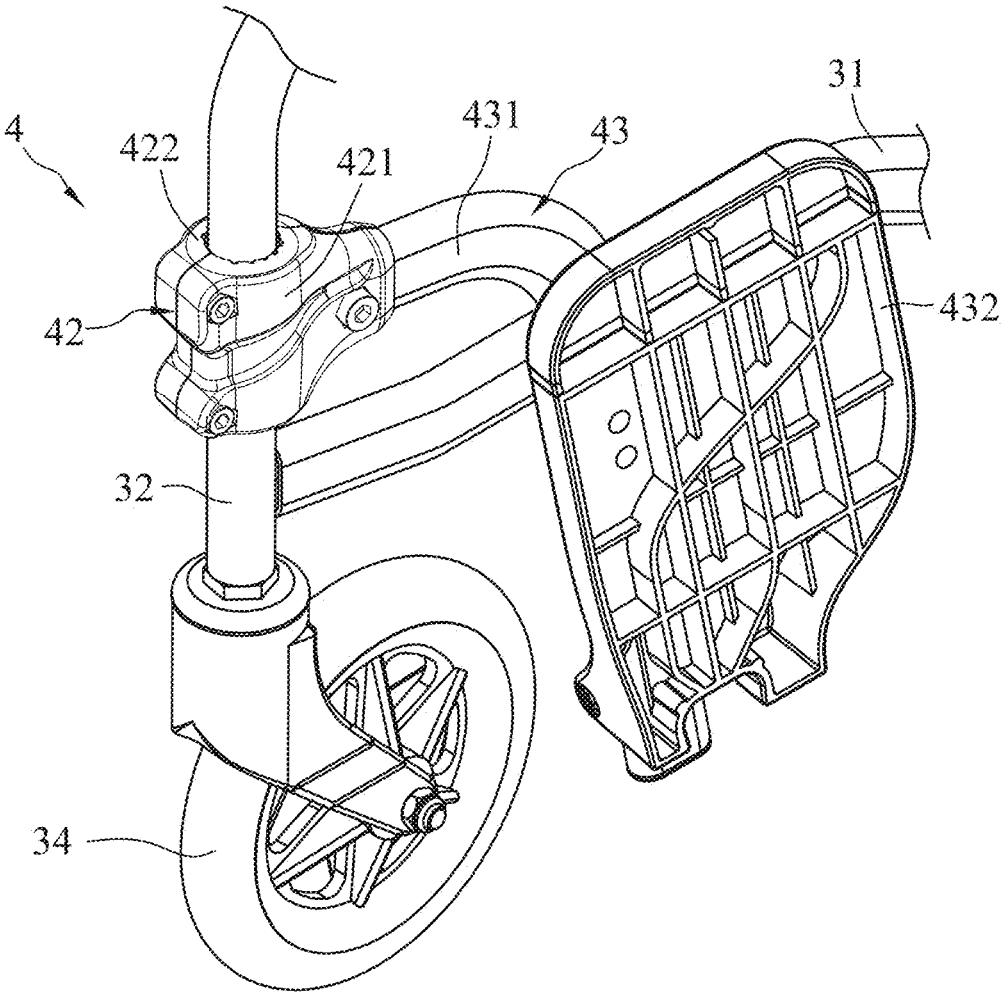
FIG. 8 is a fragmentary perspective view illustrating the pedal mechanism at an open position.

Referring to FIGS. 4 and 8, the pedal 432 is operable to switch relative the extending rod 431 between an unfolded state (see FIG. 4) and a folded state (see FIG. 8). When the pedal 432 is in the unfolded state, the pedal 432 is substantially disposed horizontally for supporting the user's foot. When the pedal 432 is in the folded state, the pedal 432 is substantially disposed vertically so that the pedal mechanism 4 occupies a relatively small space.

It should be noted that, in a modification, the pedal 432 may be pivotable relative to the extending rod 431 about a different axis, or may be separable from the extending rod 431.

Figure 7:
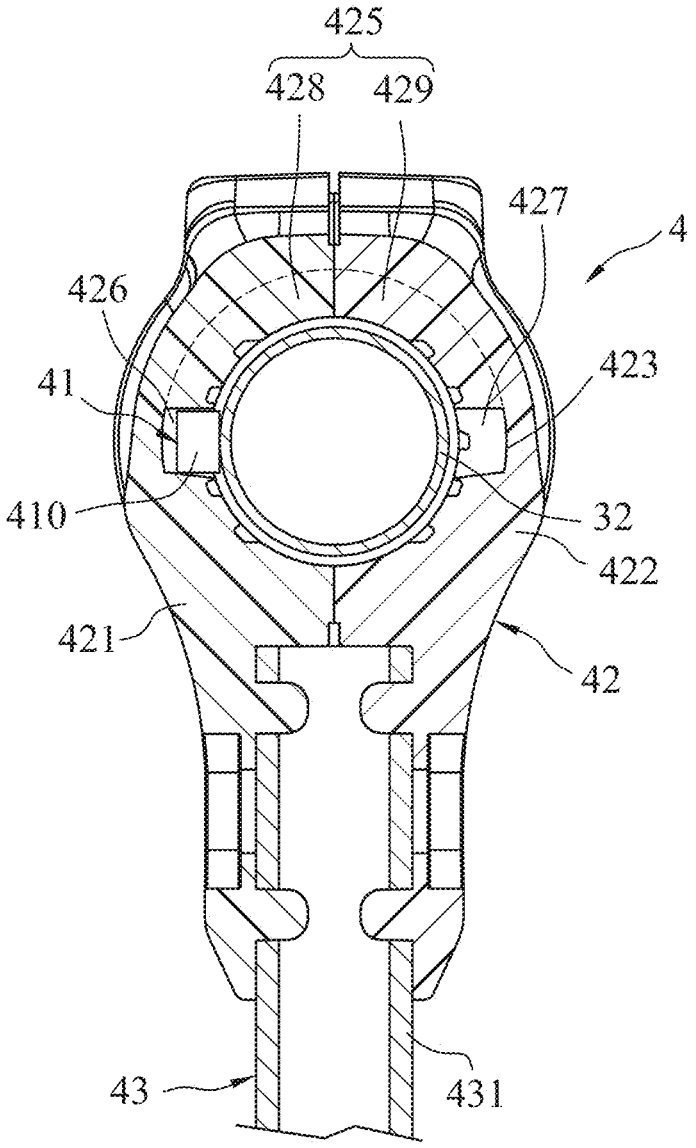
FIG. 7 is a fragmentary sectional illustrating the pedal mechanism at a close position.

Referring to FIGS. 4, 5 and 7, the pedal mechanism 4 is rotatable about and movable along the pedal-mounting rod 32 by virtue of the pivot unit 42, and is able to be positioned relative to the pedal-mounting rod 32 at a close position (see FIG. 4) or an open position (see FIG. 8). When the pedal mechanism 4 is at the close position, the head portion 410 of the bolt 411 engages the first groove section 426 of the guide groove 423 of the pivot unit 42, and the pedal unit 43 is located at the front side of the frame body 31 for supporting the user's foot.

To move the pedal mechanism 4 from the close position to the open position, the pivot unit 42 is first moved upwardly relative to the pedal-mounting rod 32 so that the head portion 410 of the bolt 411 is disengaged from the first groove section 426 of the guide groove 423 and engages the middle groove section 425. Then, the pivot unit 42 is rotated relative to the pedal-mounting rod 32 so that the head portion 410 moves along the middle groove section 425 until the head portion 410 is aligned with the second groove section 427 of the guide groove 423.

Figure 9:
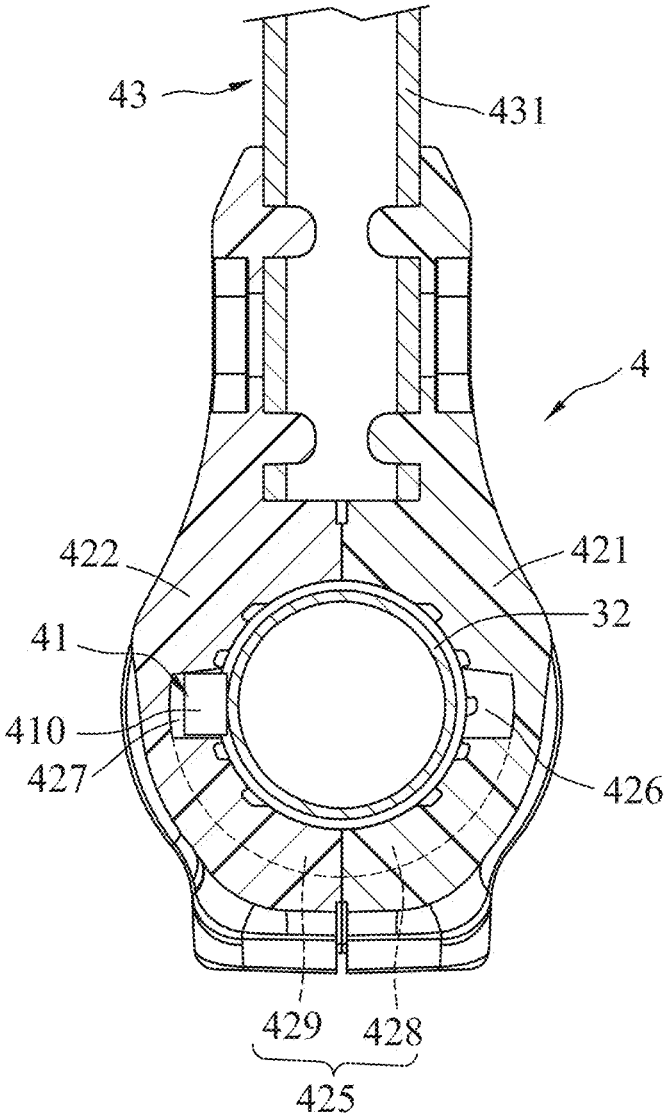
FIG. 9 is a fragmentary sectional illustrating the pedal mechanism at the open position.

Referring to FIGS. 5, 8 and 9, after the head portion 410 is aligned with the second groove section 427 of the guide groove 423, the pivot unit 42 is moved downwardly relative to the pedal-mounting rod 32 so that the head portion 410 engages the second groove section 427 to position the pedal mechanism 4 at the open position where the pedal unit 43 is located at a lateral side of the frame body 31. When both of the pedal mechanisms 4 are at the open position, a space formed between the pedal mechanisms 4 is sufficient large for exit of the user from the wheelchair 2. To move the pedal mechanism 4 from the open position to the close position, it only needs to perform the operations above in reverse order. By virtue of the head portion 410 of the bolt 411 and the first and second groove sections 426, 427 of the guide groove 423, each of the pedal mechanisms 4 can be steadily positioned at the close position or the open position, and would not be accidentally moved relative to the corresponding pedal-mounting rod 32.

Figure 10:
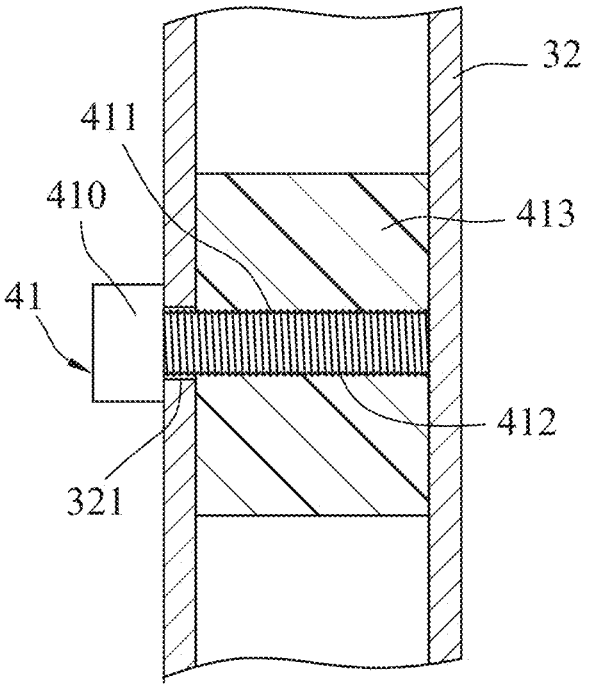
FIG. 10 is a fragmentary sectional view illustrating a second embodiment of the wheelchair according to the disclosure.

Referring to FIG. 10, the second embodiment according to the disclosure is different from the first embodiment in the positioning unit 41. In the second embodiment, the positioning unit 41 includes a stuff block 413 that is disposed in the pedal-mounting rod 32 and that is formed with a threaded installation hole 412 aligned with the mounting hole 321 of the pedal-mounting rod 32, and a bolt 411 that extends through the mounting hole 321 to engage threadedly the installation hole 412 and that has a head portion 410 disposed out of the pedal-mounting rod 32. It should be noted the nut 414 (see FIG. 6) in the first embodiment is omitted, so the positioning unit 41 of the second embodiment has a relatively simple structure.

Figure 11:
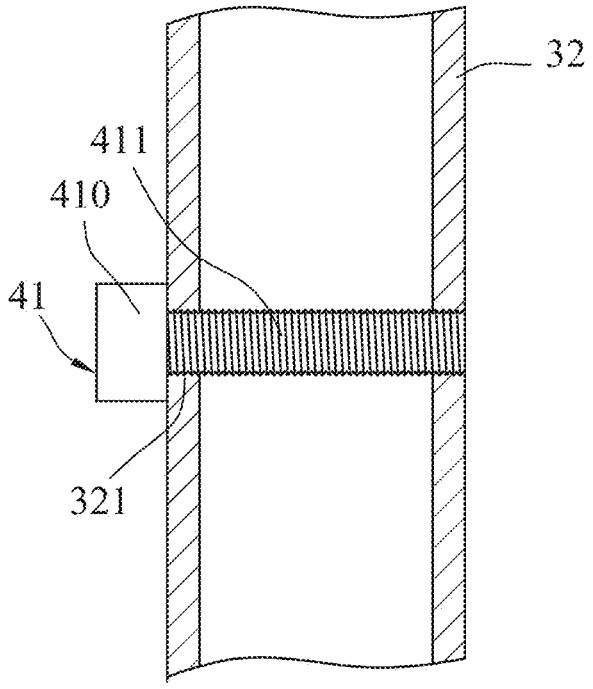
FIG. 11 is a fragmentary sectional view illustrating a third embodiment of the wheelchair according to the disclosure.

Referring to FIG. 11, the second embodiment according to the disclosure is different from the first embodiment in the positioning unit 41 and the pedal-mounting rod 32. In the third embodiment, the positioning unit 41 includes a bolt 411 that is directly threadedly mounted to the pedal-mounting rod 32 and that has a head portion 410 disposed out of the pedal-mounting rod 32 (the mounting hole 321 is configured as a threaded hole). It should be noted the stuff block 413 and the nut 414 (see FIG. 6) in the first embodiment are omitted, so the positioning unit 41 of the third embodiment has a further simplified structure.

In summary, by virtue of the positioning unit 41 and the pivot unit 42, each of the pedal mechanism 4 is pivotable relative to the corresponding pedal-mounting rod 32 by a relatively large range. Moreover, by virtue of the head portion 410 of the bolt 411 and the first and second groove sections 426, 427 of the guide groove 423, each of the pedal mechanisms 4 would not be accidentally moved relative to the corresponding pedal-mounting rod 32 after being positioned at the close position or the open position.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A wheelchair comprising:

a chair frame mechanism including a frame body, and two pedal-mounting rods that are disposed at a front side of said frame body; and two pedal mechanisms respectively mounted to said pedal-mounting rods, each of said pedal mechanisms being able to be positioned relative to said corresponding pedal-mounting rod at a close position and an open position, each of said pedal mechanisms including a pivot unit that is sleeved on said corresponding pedal-mounting rod and that is rotatable about and movable along said corresponding pedal-mounting rod, a positioning unit that is mounted to said corresponding pedal-mounting rod, that partially projects out of an outer surface of said corresponding pedal-mounting rod, and that engages said pivot unit, and a pedal unit that is mounted to said pivot unit, said pivot unit of each of said pedal mechanisms having a guide groove that is formed in an inner surrounding surface thereof and that is slidably engaged with said positioning unit, said guide groove of each of said pedal mechanisms having a middle groove section that extends in a circumferential direction of said pivot unit, and first and second groove sections that extend upwardly respectively from two opposite end of said middle groove section;

wherein, for each of said pedal mechanisms, when said pedal mechanism is at the close position, said positioning unit engages said first groove section of said guide groove, and said pedal mechanism is located at the front side of said frame body;

wherein, for each of said pedal mechanisms, when said pedal mechanism is at the open position, said positioning unit engages said second groove section of said guide groove, and said pedal mechanism is located at a lateral side of said frame body; and wherein, for each of said pedal mechanisms, said pivot unit is operable to be moved upwardly relative to said corresponding pedal-mounting rod, so that said positioning unit is disengaged from one of said first and second groove sections and engages said middle groove section so as to permit relative rotation between said pivot unit and said corresponding pedal-mounting rod for movement of said pedal mechanism between the close position and the open position.

2. The wheelchair as claimed in claim 1, wherein each of said pedal-mounting rods has a mounting hole that extends in a radial direction of said corresponding pedal-mounting rod and that is formed through the outer surface of said corresponding pedal-mounting rod, each of said positioning units of said pedal mechanisms including a bolt that extends through said mounting hole of said corresponding pedal-mounting rod and that is positioned relative to said mounting hole, said bolt of each of said positioning units being partially disposed out of said corresponding pedal-mounting rod, and being movable along said corresponding guide groove.

3. The wheelchair as claimed in claim 2, wherein each of said positioning units further includes a stuff block that is disposed in said corresponding pedal-mounting rod and that is formed with an installation hole aligned with said mounting hole of said corresponding pedal-mounting rod and permitting said bolt of said corresponding positioning unit to extend therethrough.

4. The wheelchair as claimed in claim 3, wherein each of said positioning units further includes a nut that is mounted to said corresponding stuff block and that is aligned with said corresponding installation hole, said bolt of each of said positioning units extending through said corresponding installation hole and engaging threadedly said corresponding nut.

5. The wheelchair as claimed in claim 1, wherein each of said pivot units includes interconnected first and second casings that are sleeved on said corresponding pedal-mounting rod, for each of said pivot units, said first casing being formed with said first groove section and a first middle groove part that is in spatial communication with said first groove section, said second casing being formed with said second groove section and a second middle groove part that is in spatial communication with said second groove section and that cooperates with said corresponding first middle groove part to form said corresponding middle groove section.

6. The wheelchair as claimed in claim 1, wherein each of said pedal mechanisms further includes at least one bushing that is mounted in said corresponding pivot unit and that is sleeved on said corresponding pedal-mounting rod.

7. The wheelchair as claimed in claim 6, wherein each of said pedal mechanisms includes two of said bushing that are mounted in said corresponding pivot unit and that are spaced apart from each other in a top-bottom direction.

8. The wheelchair as claimed in claim 7 wherein each of said bushings has a surrounding portion that is sleeved on said corresponding pedal-mounting rod, and an installation portion that extends radially and outwardly from said surrounding portion, each of said pivot units of said pedal mechanisms further having two installation grooves each of which permits said installation portion of a corresponding bushing to engage therewith.

9. The wheelchair as claimed in claim 1, wherein each of said pedal units of said pedal mechanisms includes an extending rod that is connected to said corresponding pivot unit, and a pedal that is pivoted to an end of said extending rod distal from said corresponding pivot unit, for each of said pedal units, said pedal being operable to switch relative said extending rod between an unfolded state in which said pedal is substantially disposed horizontally, and a folded state in which said pedal is substantially disposed vertically.

* * * * *